US005967311A

United States Patent [19]

Ruppert et al.

[11] Patent Number: 5,967,311

[45] Date of Patent: Oct. 19, 1999

[54] PACKAGING FOR CIGARETTE PAPERS AND BLANK FOR THIS PURPOSE

[75] Inventors: Heinrich W. Ruppert; Gunter Schütze, both of Trossingen, Germany

[73] Assignee: EFKA-Werke Fritz Kiehn GmbH, Munich, Germany

[21] Appl. No.: 09/149,335

[22] Filed: Sep. 8, 1998

[30] Foreign Application Priority Data

Sep. 9, 1997 [DE] Germany ..... 297 16 193
Oct. 21, 1997 [DE] Germany ..... 297 18 677

[51] Int. Cl.[6] ..... A24F 15/00

[52] U.S. Cl. ..... 206/256; 206/449; 221/305; 229/120.16

[58] Field of Search ..... 206/256, 449; 229/120.16; 221/47, 63, 305

[56] References Cited

U.S. PATENT DOCUMENTS

| | | | |
|---|---|---|---|
| 1,901,006 | 3/1933 | Spain . | |
| 2,501,357 | 3/1950 | Speckman . | |
| 2,636,599 | 4/1953 | Willis et al. | 206/449 |
| 5,158,205 | 10/1992 | Bodziak et al. | 221/47 |

FOREIGN PATENT DOCUMENTS

| | | |
|---|---|---|
| 00 64 132 | 11/1982 | European Pat. Off. . |
| 296 172 | 6/1916 | Germany . |
| 83 15 844 | 8/1983 | Germany . |
| 93 10 382 | 9/1993 | Germany . |
| 95/33 667 | 12/1995 | WIPO . |

*Primary Examiner*—David T. Fidei
*Attorney, Agent, or Firm*—Knobbe, Martens, Olson, & Bear, LLP

[57] ABSTRACT

A package for accommodating at least two blocks of cigarette papers includes a longitudinal front and rear walls, a closure tab, end walls and a divider. The longitudinal front wall has at least two paper removal slots spaced apart from one another and extending parallel to one another. The longitudinal rear wall is connected to the front wall by a first fold line, and the closure tab is connected to the front wall by a second fold line. The closure tab is foldable onto the rear wall. The end walls are opposite one another and defined by foldable material side tabs each connected to at least one of the front and rear walls by a third fold line which is transverse to the longitudinal front wall. The divider is located in an area between the two paper removal slots in the front wall and configured to permanently separate the two paper blocks within the package.

17 Claims, 4 Drawing Sheets

PACKAGING FOR CIGARETTE PAPERS AND BLANK FOR THIS PURPOSE

FIELD OF THE INVENTION

The invention relates to a packaging for accommodating at least two blocks of cigarette papers and to a blank for producing such a packaging.

BACKGROUND OF THE INVENTION

Packagings for accommodating two blocks of cigarette papers are known. These consist of a front wall with two paper removal slots spaced apart from one another and extending parallel to one another, a rear wall connected to the front wall and defined by two first fold lines spaced apart from one another or a longitudinal side wall defined between these, a closure tab connected to the front wall and defined by two second fold lines spaced apart from one another or a second longitudinal side wall defined between these, said closure tab being foldable onto the inner side of the rear wall and being connectable therewith, and two end walls, facing one another, which are defined by inner covers respectively connected to the front wall by a transverse fold line or inwardly foldable tabs of material. Associated with each paper removal slot in the front wall of the packaging is a block of cigarette papers. The cigarette papers are folded in a zig-zag manner and are interleaved in one another to form respective blocks of paper. Upon removal of the cigarette paper through one of the two paper removal slots, a portion of the next paper in succession is also drawn through the removal slot, so that the next paper is again available ready to be grasped.

There may also be associated with the front wall a covering wall, which is connected to the rear wall and is foldable over the front wall.

The known packages have the disadvantage that if the consumer does not draw the papers alternately out of the two removal slots, one paper block is totally or almost totally removed with the consequence that the other paper block can then move within the package. Then there is the risk that papers projecting out of the removal slot associated with the larger paper block will likewise slip with the paper block and disappear in the package. Although the package still contains sufficient papers, no further paper can be drawn from the removal slot.

SUMMARY OF THE INVENTION

The object of the present invention is to provide a package of the abovenamed type and a blank therefor, in which the at least two papers blocks are secured against sliding inside the package, and independently of the number of papers removed from the at least two paper blocks. Thus the association of the paper blocks to the removal slots is to be ensured until the end, i.e. until the last paper has been removed.

This object is achieved with respect to the package accommodating at least two blocks of cigarette papers. The package for accommodating at least two blocks of cigarette papers includes a longitudinal front and rear walls, a closure tab, end walls and a divider. The longitudinal front wall has at least two paper removal slots spaced apart from one another and extending parallel to one another. The longitudinal rear wall is connected to the front wall by a first fold line, and the closure tab is connected to the front wall by a second fold line. The closure tab is foldable onto the rear wall. The end walls are opposite one another and defined by foldable material side tabs each connected to at least one of the front and rear walls by a third fold line which is transverse to the longitudinal front wall. The divider is located in an area between the two paper removal slots in the front wall and configured to permanently separate the two paper blocks within the package. The package is manufactured from a corresponding package blank comprising a front wall, a rear wall, a closure tab and longitudinal side walls located between the front and rear walls and between the front wall and closure tab, respectively, the side wall being separated from the front and rear wall and the rear wall and the closure tab, respectively, by a first pair of fold lines. Material tabs are foldable inward onto surfaces of at least one of the front and rear walls, respectively. The material tabs are configured to laterally connect first sections defining at least one of the front wall and rear wall via at least one fold line. A least two spaced-apart paper removal slots are formed in a second section defining the front wall, the slots extending parallel to one another and in a longitudinal direction of the packaging. A divider having at least one tab of material stamped out between the paper removal slots is configured in such a way that the divider can be folded inward around a fold line into an interior of a packaging produced from the blank.

The core of the present invention thus resides in the arrangement of separating means between the two paper blocks within the package. Preferably, for this purpose, in the region between the two paper removal slots in the front wall, at least one tab of material stamped therefrom and/or from the rear wall is folded inwards for permanent separation of the two paper blocks within the package. Constructive solutions for this are described in the sub-claims.

BRIEF DESCRIPTION OF THE DRAWINGS

In the following, various embodiments of a blank design according to the invention and of a package produced from such a blank will be described in more detail with reference to the annexed drawing which shows.

DETAILED DESCRIPTION OF THE INVENTION

Figure 1:
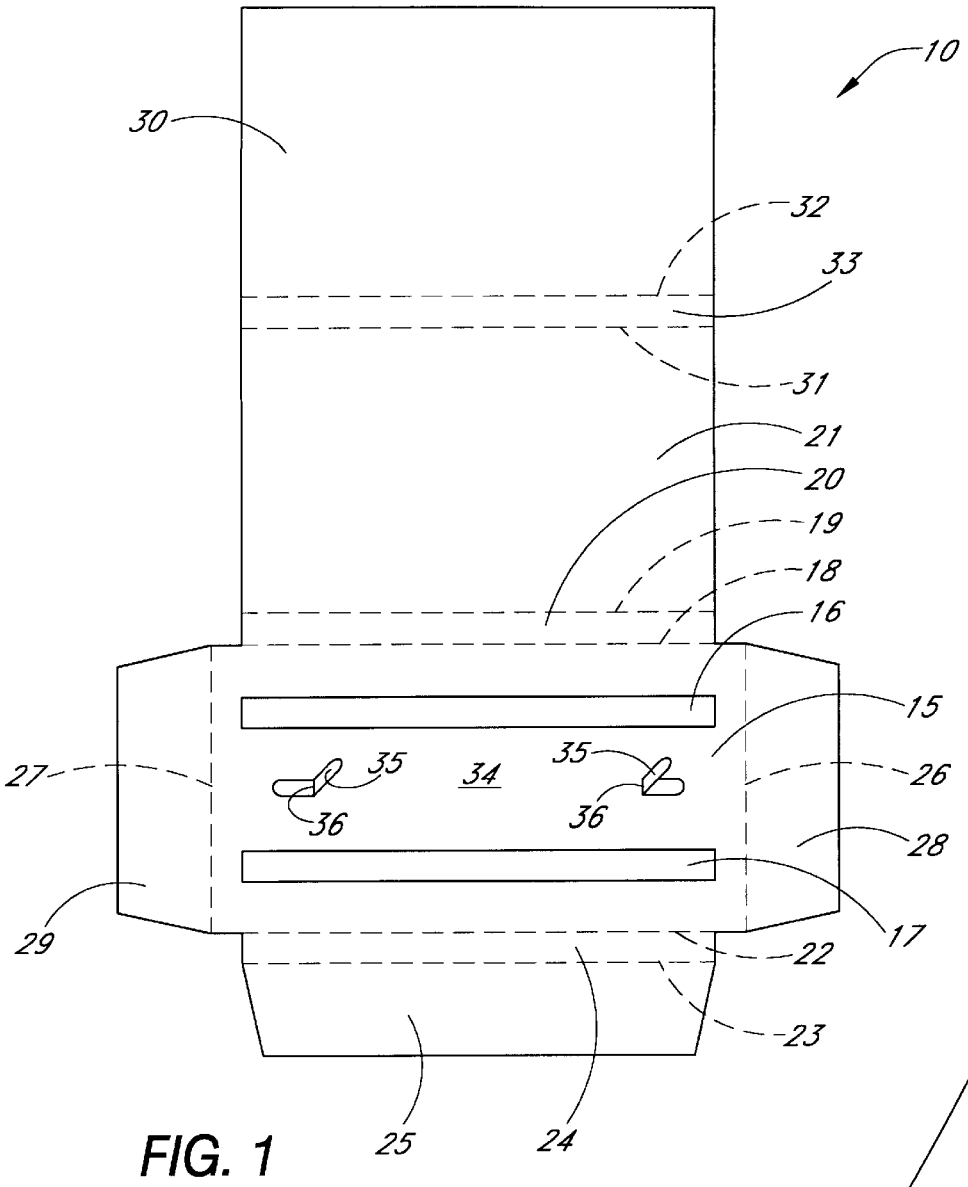
FIG. 1: a first embodiment of a blank designed according to the invention, in plan view.

FIG. 1 shows a blank 10, spread out flat, for producing a package 14 (FIG. 2), which serves to accommodate two blocks 11, 12 of cigarette papers 13. The blank 10 comprises a plurality of wall sections, i.e. a front wall 15 with two paper removal slots 16, 17 spaced apart from one another and extending parallel to one another, a rear wall 21 connected to the front wall 15 and defined by two first fold lines 18, 19 spaced apart from one another or a first longitudinal wall 20 defined between these, a closure tab 25 connected to the front wall 15 and defined by two fold lines 22, 23 spaced apart from one another or a second longitudinal side wall 24 defined between these, said closure tab 25 being foldable onto the inner side of the rear wall 21 and being connectable thereto, particularly by adhesion, and two end walls lying opposite one another, which are defined by inner covers connected respectively by at least one transverse fold line 26 or 27 to the front wall 15, or by inwardly foldable tabs of material 28, 29.

In the embodiment shown, another cover wall 30 is provided, which is connected to the rear wall 21 by two third fold lines 31, 32 spaced apart from one another or a longitudinal side wall 33 defined between these, and which is foldable over the front wall 15. Thus the two removal slots 16, 17 may be covered, so that the graspable sections of the cigarette papers 13 projecting out of the removal slots 16, 17 are not damaged when the package is stowed in a pocket.

Figure 2:
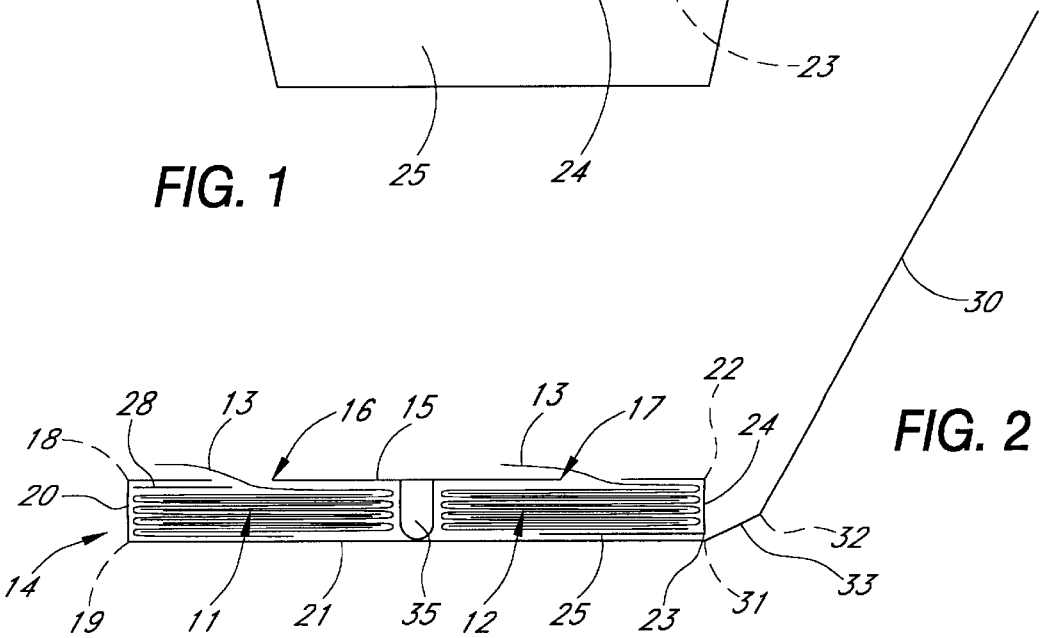
FIG. 2: a package produced from a blank according to FIG. 1, in schematic cross-section.

In the embodiment according to FIGS. 1 and 2 in the region 34 between the two paper removal slots 16, 17 in the front wall 15, two tabs of material 35, stamped out of the front wall 15, are inwardly folded within the package 14 for permanent separation of the two paper blocks 11, 12 (see FIG. 2). The tabs of material 35 in the area 34 between the two removal slots 16, 17 are located centrally and at a longitudinal spacing apart. The stamping of the tabs of material 35 is such that these are folded inwards about fold lines 36 extending transversely to the longitudinal direction of the package. The length of the fold lines 36 extending transversely to the longitudinal direction thus defines the width of the inwardly folded tabs of material 35 and thus the width of the slot between the two paper blocks 11, 12 inside the package 14, as can be clearly seen in FIG. 2. The tabs of material 35 prevent slippage of the paper blocks 11, 12 within the package even when the removal of papers 13 from the two removal slots 16, 17 differs widely. Even if a paper block is already used up, the other paper block cannot slip within the package, i.e. be removed from the removal slot associated therewith, in such a way that no further papers can be removed.

Figure 3:
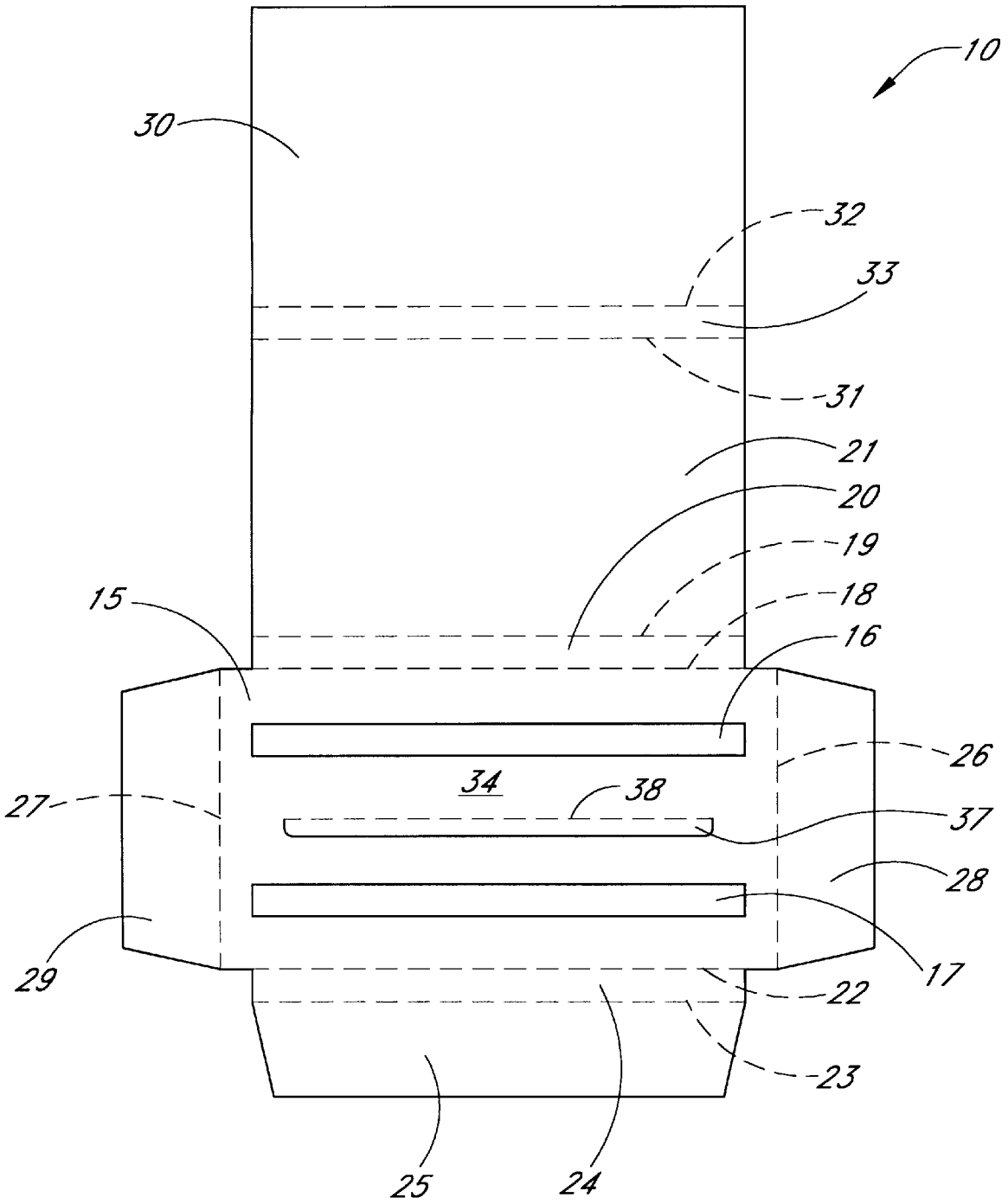
FIG. 3: a second embodiment of a blank designed according to the invention, in plan view.
Figure 4:
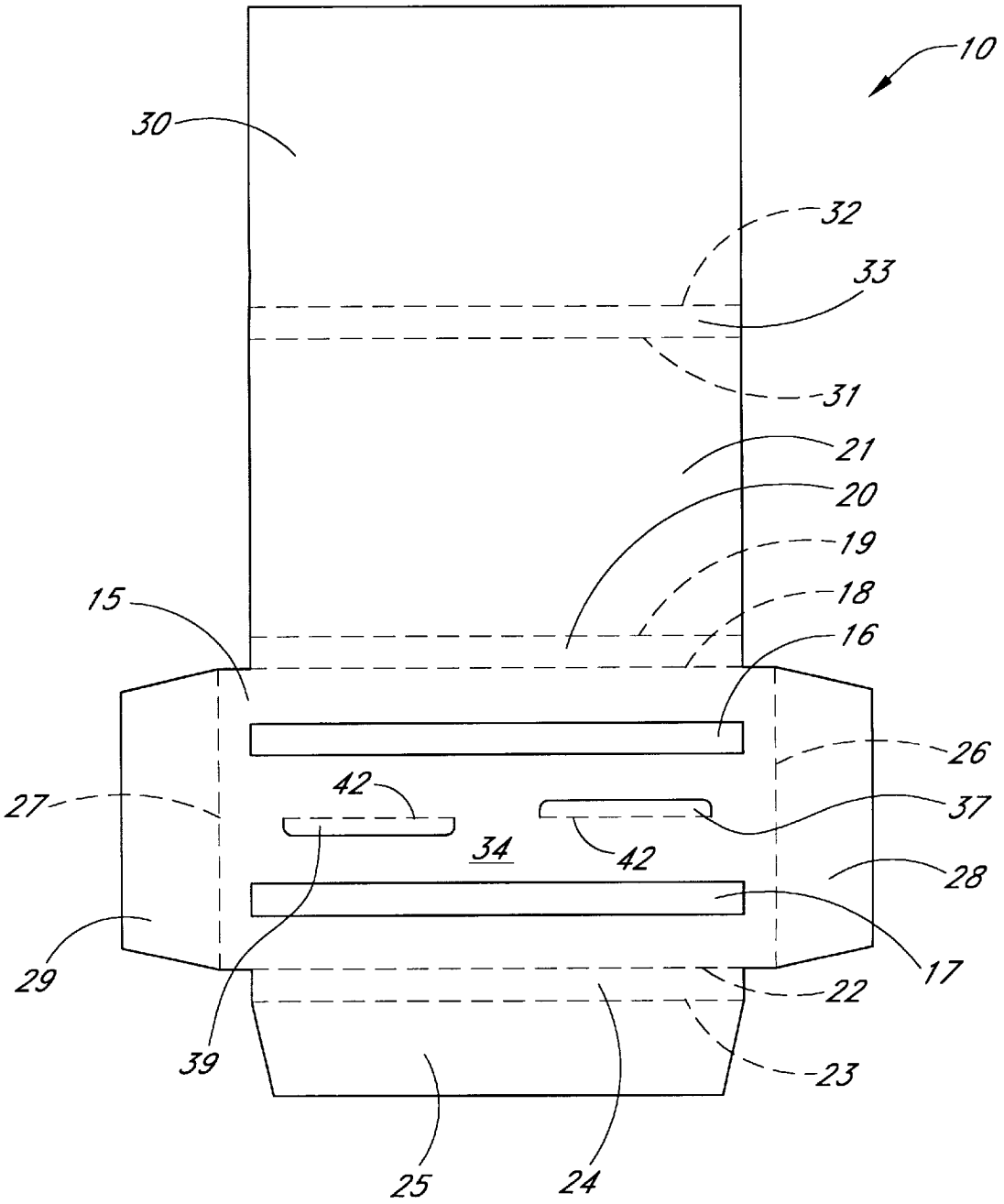
FIG. 4: a third embodiment of a blank designed according to the invention in plan view.

FIG. 3 shows, spread out flat, a second embodiment of a material blank 10 for producing a package 14 according to FIG. 2. This material blank differs from that in FIG. 1 only by the altered embodiment of the separating means between the two paper blocks 11, 12 within the package 14 in the region 34 between the two removal slots 16, 17 in the front wall 15. In concrete terms, a material tab 37 extending parallel to the separating slots and extending roughly centrally between them is stamped out here between the two paper removal slots 16, 17 and is foldable inwards about fold line 38 extending parallel to the longitudinal direction of the removal slots 16, 17 or package 14, and when two tabs of material 39, 40 are formed, as is shown in FIG. 4, these are located one behind the other in the longitudinal direction. In accordance with the embodiment in FIG. 4, the two tabs of material 39, 40 are located one behind the other in such a way that their fold lines 41, 42 are flush with one another in the longitudinal direction. Moreover the stamping of the material tabs is such that one material tab 39 faces one removal slot 17 and the other material tab 40 faces the other removal slot 16. In this way a reliable separation of the two paper blocks 11, 12 within the package 14 is achieved, as the resistance on both sides of the material tabs 39, 40 against slippage of the paper blocks within the package is equal. The inwardly folded material tabs 35 or 37 or 39, 40 between the two paper removal slots 16, 17 preferably have a width or height which corresponds to the clear height of the package, i.e. the height of the package in the interior of the same (see FIG. 2).

It can be seen from the above description that the blank 10 according to FIG. 4 differs from that according to FIG. 3 only in the differing formation of the material tabs in the region 34 between the two removal slots 16, 17. Moreover the basic structure of all the blanks 10 in FIGS. 1, 3 and 4 is the same. The package 14 also, when the blanks 10 shown are used, is similarly conceived. Only the separating means between the two paper blocks 10, 12 within the package 14 differ as described above.

Basically it is also imaginable to attach in the area between the two removal slots 16, 17 on the inner side of the front wall 15, separate separating means e.g. separating webs, particularly by gluing. This embodiment is however more complex in manufacturing terms than the embodiments described. The basic idea of the present invention however is the arrangement of such separating means between the paper blocks 11, 12 within the package 14, so that slippage of the paper blocks is not possible.

Figure 5:
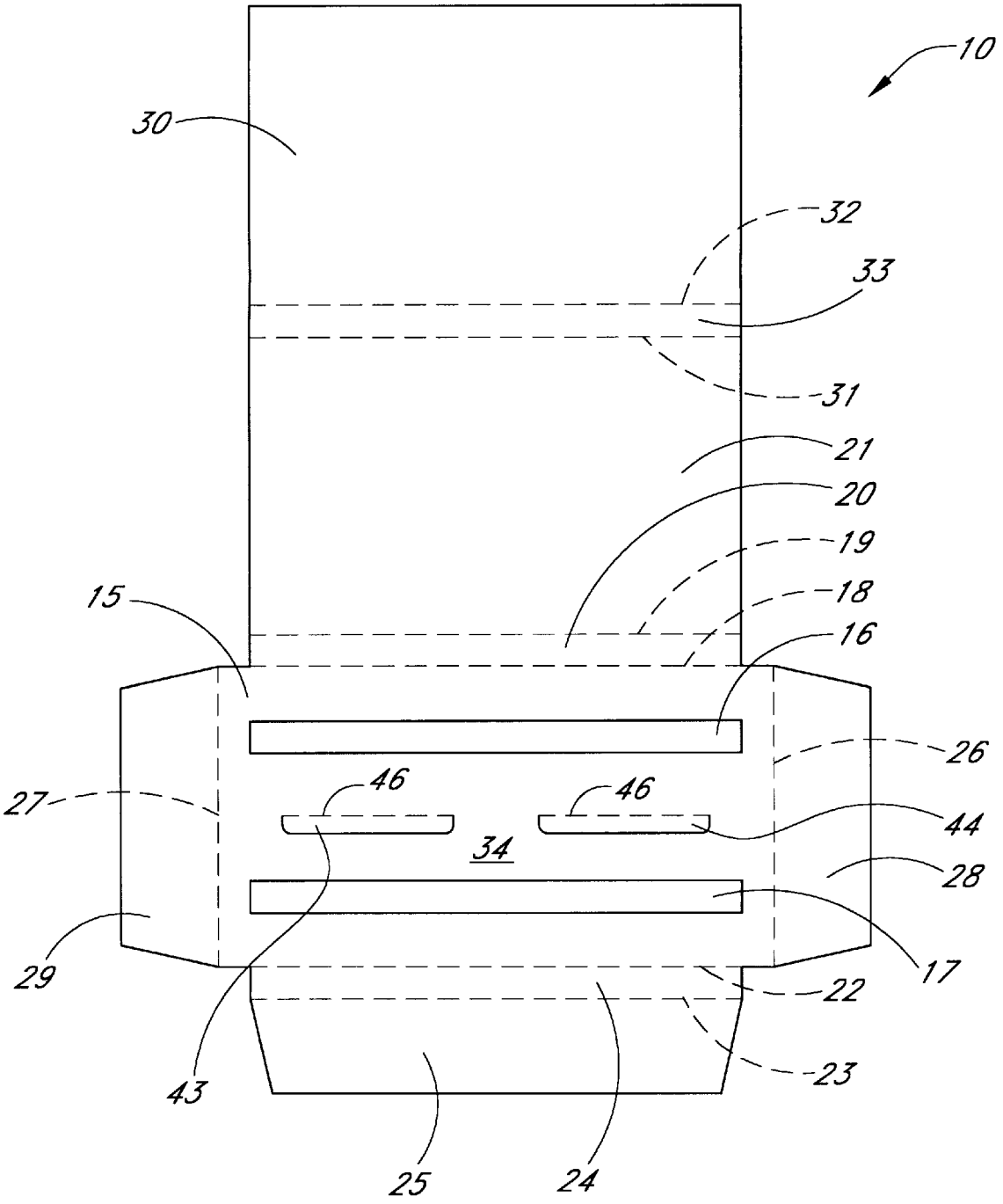
FIG. 5: a fourth embodiment of a blank designed according to the invention in plan view.

The embodiment according to FIG. 5 corresponds to that in FIG. 4, with the only difference that the two material tabs 43, 44 between the two removal slots 16, 17 are stamped out in such a way that they both face either one or the other removal slot, in this case removal slot 17.

The design of two or more separated material tabs, such as for example in the embodiment in FIGS. 1, 4 and 5 has the advantage that the front wall 15 remains relatively rigid in comparison to a solution with a continuous material tab stamping according to FIG. 3.

All the features disclosed in the application documents are claimed as essential to the invention, insofar as, individually or in combination, they are new in relation to prior art.

List of Reference Numbers

10 Blank
11 Paper Block
12 Paper Block
13 Cigarette Paper
14 Package
15 Front Wall
16 Paper Removal Slot
17 Paper Removal Slot
18 First Fold Line
19 First Fold Line
20 First Longitudinal Side Wall
21 Rear Wall
22 Second Fold Line
23 Second Fold Line
24 Second Longitudinal Side Wall
25 Closure Tab
26 Transverse Fold Line
27 Transverse Fold Line
28 Inner Cover
29 Inner Cover
30 Cover Wall
31 Third Fold Line
32 Third Fold Line
33 Longitudinal Side Wall
34 Intermediate Area
35 Material Tab
36 Fold Line
37 Material Tab
38 Fold Line
39 Material Tab

40 Material Tab

41 Fold Line

42 Fold Line

43 Material Tab

44 Material Tab

What is claimed is:

1. A package for accommodating at least two blocks of cigarette papers, comprising:

a longitudinal front wall having at least two paper removal slots spaced apart from one another and extending parallel to one another;

a longitudinal rear wall connected to the front wall by a first fold line;

a closure tab connected to the front wall by a second fold line, the closure tab being foldable onto the rear wall;

two end walls opposite one another, defined by foldable material side tabs each connected to at least one of the front and rear walls by a third fold line which is transverse to the longitudinal front wall; and a divider located in an area between the two paper removal slots in the front wall, the divider configured to permanently separate the two paper blocks within the package when the blocks of cigarette papers are placed within the package.

2. The package according to claim 1, wherein the divider is further configured as at least one material tab stamped out of at least one of the front and rear walls, the at least one material tab being folded inward.

3. The package according to claim 2, wherein the at least one inwardly folded material tab between the two paper removal slots in the front wall of the package has a height which corresponds to a clear height in an interior of the package.

4. The package according to claim 1, further comprising a cover wall connected to the rear wall by a fourth fold line.

5. The package according to claim 4, wherein the cover wall is connected to the rear wall by the fourth fold line and a fifth fold line which are spaced apart from each other so that a longitudinal side wall is defined between the fourth and fifth fold lines.

6. The package according to claim 1, wherein the rear wall is connected to the front wall by the first fold line and a sixth fold line.

7. The package according to claim 1, wherein the closure tab is connected to the front wall by the second fold line and a seventh fold line.

8. The package according to claim 1, wherein the closure tab is foldable onto one of an inner side and outer side of the rear wall.

9. The package according to claim 1, wherein each of the two end walls is connected to one of the front and rear walls by the third fold line and an eighth fold line which are spaced apart from each other.

10. The package according to claim 2, wherein the at least one material tab extends parallel to the at least two paper removal slots and generally centrally between the removal slots, and wherein the at least one material tab is folded inward at a ninth fold line extending parallel to the at least two paper removal slots in longitudinal direction of the front wall.

11. The package according to claim 2, wherein the divider is configured to have two material tabs which extend parallel to the at least two paper removal slots and generally centrally between the removal slots, wherein the two material tabs are folded inward at a pair of tenth fold lines extending parallel to the at least two paper removal slots in longitudinal direction of the front wall, and wherein the two material tabs are located serially in the longitudinal direction of the front wall.

12. The package according to claim 2, wherein the at least one material tab extends from the front wall, and wherein the at least one material tab is folded inward at an eleventh fold line extending transversely to in the longitudinal direction of the front wall.

13. The package according to claim 11, wherein the two material tabs are stamped out to face one of the paper removal slots.

14. The package according to claim 11, wherein the two material tabs are stamped out to face different paper removal slots.

15. The package according to claim 12, wherein the eleventh fold line has a length which defines a spacing between the two paper blocks within the package.

16. The package according to claim 1, wherein two blocks of cigarette papers are placed in the package, one on each side of the dividers, and positioned so the paper can be removed from the blocks through the removal slots.

17. A blank for a package comprising a substantially rectangular blank of material, the blank of material comprising:

a front wall;

a rear wall;

a closure tab;

longitudinal side walls located between the front and rear walls and between the front wall and the closure tab, respectively, the side walls being separated from the front and rear walls and the rear wall and the closure tab, respectively, by a first pair of fold lines;

material tabs foldable inward onto surfaces of at least one of the front and rear walls, respectively, the material tabs configured to laterally connect first sections defining at least one of the front wall and rear wall via at least one first fold line;

at least two spaced-apart paper removal slots being formed in a second section defining the front wall, the slots extending parallel to one another and in a longitudinal direction of the packaging; and a divider having at least one tab of material stamped out between the paper removal slots in such a way that the divider can be folded inward at a second fold line into an interior of a packaging produced from the blank.

* * * * *